US007316765B2

(12) United States Patent
Tojo et al.

(10) Patent No.: US 7,316,765 B2
(45) Date of Patent: Jan. 8, 2008

(54) APPARATUS AND METHOD FOR MOLTEN SALT ELECTROLYTIC BATH CONTROL

(75) Inventors: Tetsuro Tojo, Osaka (JP); Jiro Hiraiwa, Osaka (JP); Osamu Yoshimoto, Osaka (JP)

(73) Assignee: Toyo Tanso Co., Ltd., Osaka-shi (JP)

( * ) Notice: Subject to any disclaimer, the term of this patent is extended or adjusted under 35 U.S.C. 154(b) by 389 days.

(21) Appl. No.: 10/879,135

(22) Filed: Jun. 30, 2004

(65) Prior Publication Data

US 2005/0011766 A1 Jan. 20, 2005

(30) Foreign Application Priority Data

Jul. 14, 2003 (JP) ..... 2003-196622
Feb. 16, 2004 (JP) ..... 2004-038263

(51) Int. Cl.
*C25B 15/02* (2006.01)

(52) U.S. Cl. ..... 204/228.4; 204/228.2; 204/228.3; 204/243.1; 204/247.5; 205/336; 205/354

(58) Field of Classification Search ..... 204/243.1, 204/228.2, 228.3, 228.4, 228.6, 247.5; 205/336, 205/354, 359, 391, 392, 394, 396
See application file for complete search history.

(56) References Cited

U.S. PATENT DOCUMENTS 5,294,306 A * 3/1994 Howard et al. ..... 205/336
5,688,384 A 11/1997 Hodgson et al.
6,818,105 B2 * 11/2004 Tojo et al. ..... 204/240
2003/0057102 A1 * 3/2003 Beck ..... 205/376
2004/0007457 A1 * 1/2004 Tojo et al. ..... 204/247
2004/0099537 A1 * 5/2004 Hiraiwa et al. ..... 205/411
2005/0161321 A1 * 7/2005 Kennedy et al. ..... 204/277

FOREIGN PATENT DOCUMENTS

| | | | |
|---|---|---|---|
| CN | 1137808 | A | 12/1996 |
| EP | WO 02/10486 | A1 | 2/2002 |
| EP | 1 283 280 | A1 | 2/2003 |
| EP | WO 03/056066 | A2 | 7/2003 |
| JP | 04-009488 | A | 1/1992 |
| JP | 9-505853 | | 6/1997 |
| JP | 2002-339090 | A | 11/2002 |
| KR | 2003-0019338 | | 2/2006 |
| WO | WO 96/08589 | | 3/1996 |

* cited by examiner

*Primary Examiner*—Bruce F. Bell
(74) *Attorney, Agent, or Firm*—Oblon, Spivak, McClelland, Maier & Neustadt, P.C.

(57) ABSTRACT

An apparatus for controlling a molten salt electrolyzer in which an electrolytic bath in a solid form as contained in the electrolyzer is melted to automatically attain a state allowing electrolysis, which apparatus comprises detecting means for detecting the changes in state of the electrolyzer by means of detectors fitted to the electrolyzer, and adjusting means for adjusting, after using the detecting means, the liquid electrolytic bath levels to a state allowing electrolysis.

8 Claims, 3 Drawing Sheets

APPARATUS AND METHOD FOR MOLTEN SALT ELECTROLYTIC BATH CONTROL

FIELD OF THE INVENTION

The present invention relates to an apparatus and a method for molten salt electrolytic bath control.

BACKGROUND OF THE INVENTION

The molten salt electrolyzer often contains in the inside thereof a highly reactive or toxic molten salt as an electrolytic bath, and the electrolyzer is made ready for electrolysis by forming a closed space and heating the electrolytic bath to melt the salt material. The judgment as to whether the electrolyzer is ready for electrolysis as a result of completion of the melting of the electrolytic bath is made by an operator based on the electrolyzer temperature information and other information and based on his/her own experience. The electrolytic bath has a high melting point and occurs as a solid at ordinary temperature. Generally, the gaseous phase section in the electrolyzer is divided into an anode compartment or chamber and a cathode compartment or chamber by insertion of a partition wall into the electrolytic bath. The electrolytic bath may solidify in a state of unbalance between the anode chamber and cathode chamber according to the pressure conditions in the electrolyzer in the process of solidification of the electrolytic bath. In some instances, even when the electrolytic bath in such state is remelted, the liquid level unbalance remains undissolved and it is difficult to carry out electrolysis safely.

An example of this type of molten salt electrolyzer is described in Japanese Patent Laid-Open Application (JP Kokai) No. 2002-339090 (Patent Document 1). The electrolyzer described in Patent Document 1 is a fluorine gas generator for generating highly pure fluorine gas by electrolysis of a hydrogen fluoride-containing mixed molten salt and comprises an electrolytic cell divided into an anode chamber and a cathode chamber by means of a partition wall, and pressure maintenance means for maintaining the pressures in the anode chamber and cathode chamber at a predetermined level through gas feeding to and/or gas discharging from the anode chamber and cathode chamber. The bath liquid surface in the electrolyzer is maintained in an equilibrium state by the pressure maintenance means during steady electrolytic operation.

Meanwhile, on the occasion of stopping the operation of the fluorine gas generator, the inlet and outlet of the electrolyzer are first closed, and the electrolytic operation is then stopped. Generally, a carbon electrode is employed as the anode of the electrolyzer. The fluorine gas remaining in the anode chamber is adsorbed on this carbon electrode and the pressure in the anode chamber decreases accordingly, with the result that the bath liquid surface in the anode chamber arises as compared with the level in the cathode chamber, bringing about an unbalanced state. In stopping the fluorine gas generator, the heating of the electrolyzer is also stopped and, therefore, as the temperature lowers, the electrolytic bath solidifies while maintaining that liquid level unbalance.

As mentioned above, the electrolyzer is operated for electrolysis while melting the electrolytic bath by heating in a closed space, and the judgment as to whether the electrolyzer is ready for electrolysis as a result of completion of the melting of the electrolytic bath is made by an operator based on the electrolyzer temperature information and other information and based on his/her own experience. The electrolyzer temperature information consists of the results of temperature measurements at parts of the electrolytic bath contained in the electrolytic cell and weighing several hundred kilograms to several tons. Therefore, it is possible that the electrolytic bath is not yet in a completely molten state due to insufficient heating and/or thermal insulation and, in such case, in particular when the bath remains solid around one or both electrodes, the passage of electric current is impossible. Even when the bath is in a partially molten state around the electrodes, the materials for electrolysis in the electrolytic bath begin to be consumed with the start of electrolysis and the electrolytic bath around the current-carrying portions begins to change in composition to the higher melting point side. At worst, the melting point arrives at a level exceeding the limitations of the heating means of the apparatus and the bath precipitates out on the electrode surface. Once placed in such a state, it is also very difficult to restore the normal state by melting the solidified electrolytic bath again. Therefore, it is very important to confirm the state of melting of the electrolytic bath prior to starting electrolysis. For realizing this, it is necessary to open the lid or covering of the electrolyzer. However, the molten salt contained in the electrolyzer is highly reactive and toxic, hence it is undesirable to open the electrolyzer while the electrolytic bath is in a molten state. In addition, there is a fear that some or other impurity or impurities may enter the electrolyzer on the occasion of opening, serving as a factor in decreasing the purity of the product or products. It is in reality difficult to open the electrolyzer for confirming the state of the inside. Thus, the advent of a control method by which judgment can be made as to whether the bath is in a sufficiently molten state without opening the electrolyzer is awaited for safely operating such molten salt electrolyzer.

If when the bath surface is in a solidified state in an unbalanced condition, electrolysis is started while the unbalance is not yet dissolved on the occasion of remelting, the electrodes are partly placed under abnormal load conditions because of the electrolysis conditions differing from the normal ones. Further, when the electrolytic bath liquid level unbalance is found in the vicinity of the lower end of the partition wall separating the anode chamber and cathode chamber from each other, the possibility of the gases generated in the anode chamber and cathode chamber, respectively, mixing with each other becomes high and, in particular in electrolytic fluorine generation, explosion will happen if fluorine generated from the anode and hydrogen generated from the cathode mix with each other in the gaseous phase. This explosion may damage the carbon anode supported in the electrolyzer or the electrolyzer itself. For these reasons, a control method is demanded by which the electrolytic bath levels can be balanced so that electrolysis can be safely restarted after remelting the electrolytic bath in the molten salt electrolyzer.

The present invention, which has been made in view of the problems discussed above, has for its object to provide a control apparatus or system and a control method by which the transition from the bath melting step to the state allowing the start of electrolysis in a molten salt electrolyzer can be safely achieved.

SUMMARY OF THE INVENTION

To accomplish the above object, the invention provides an apparatus for controlling a molten salt electrolyzer, which is an apparatus for controlling a molten salt electrolyzer in which an electrolytic bath in a solid form as contained in the electrolyzer is melted to automatically attain a state allowing electrolysis, which apparatus comprises detecting means for detecting the changes in state of the electrolyzer by means of detectors fitted to the electrolyzer, and adjusting means for adjusting, after using the detecting means, the liquid electrolytic bath levels to a state allowing electrolysis.

After the start of heating the electrolyzer to melt the solid-form electrolytic bath, the changes in state of the electrolyzer are detected using the detectors fitted to the electrolyzer and thereby whether the melting of the electrolytic bath in the electrolyzer has proceeded to a predetermined level or not is indirectly judged. Based on this judgment, the liquid electrolytic bath surface levels are adjusted, after complete melting of the bath, to a state allowing electrolysis; in this way, the molten salt electrolytic bath can be automatically and safely shifted from the solid state to a state allowing the start of the operation.

The molten salt electrolyzer controlling apparatus of the invention is preferably one having confirming means for confirming the completion of melting of the electrolytic bath.

Even if, in finally judging that the extent of melting is such that electrolysis can be carried out safely, the judgment of the state of melting of the electrolytic bath is poor, it becomes possible to automatically and safely cause shifting from the state in which the molten salt electrolytic bath is in a solid form to a state in which the operation can be safely started by laying down an additional judgment criterion, verifying this based on experimental facts, rejudging of the completion of melting of the electrolytic bath based on the additional judgment criterion thus established and, after complete melting of the bath, adjusting the liquid electrolytic bath surface levels to a state allowing electrolysis.

Further, the molten salt electrolyzer controlling apparatus of the invention is preferably one in which the detectors fitted to the electrolyzer for detecting the changes in state of the electrolyzer are detectors of at least one type selected from among detectors capable of detecting changes in electric resistance of the electrolytic bath, pressure detectors, and temperature detectors.

The detectors capable of detecting changes in electric resistance of the electrolytic bath make it possible to indirectly judge of the state of melting of the electrolytic bath by measuring the changes in electric resistance in the process of shifting of the electrolytic bath from the solid form to the liquid form, the pressure detectors make it possible to indirectly judge of the state of melting of the electrolytic bath based on the rises in pressure in the electrolyzer due to the increasing vapor pressure of the electrolytic bath components as accompanying the rising temperature of the electrolytic bath in the process of shifting of the electrolytic bath from the solid form to the liquid form, and the temperature detectors make it possible to indirectly judge of the state of melting of the electrolytic bath by confirming the changes in temperature in the process of shifting of the electrolytic bath from the solid form to the liquid form due to heating of the electrolyzer.

While, even when they are of one type, these detectors can be used as the means for judgment, the use of detectors of a plurality of types makes it possible to judge in further detail of the state in the electrolyzer.

When the liquid electrolytic bath surface levels are adjusted to a state allowing electrolysis after judgment of the complete melting of the bath, the automatic and safe shifting from the state in which the molten salt electrolytic bath is in a solid form to a state allowing the start of the electrolytic operation becomes possible.

Further, the molten salt electrolyzer controlling apparatus of the invention is preferably one in which the detectors fitted to the electrolyzer and capable of detecting the changes in electric resistance are detectors each constituted of a conduction type detecting sensor and an alternating current type conduction detector and inserted in the electrolytic bath.

When such detectors constituted of a conduction type detecting sensor and an alternating current type conduction detector and inserted in the electrolytic bath are used, the sensors can directly detect the liquid electrolytic bath surface levels and, therefore, the state of the electrolytic bath can be known more actually. Upon judgment using such means, the liquid electrolytic bath surface levels can be adjusted, after complete melting of the bath, to a state allowing electrolysis and, thus, the automatic and safe shifting from the state in which the molten salt electrolytic bath is in a solid form to a state allowing the start of the electrolytic operation becomes possible.

The invention further provides a method of controlling a molten salt electrolyzer, which is a method of controlling a molten salt electrolyzer for automatically converting, by melting, a solid electrolytic bath contained in an electrolyzer to a state allowing electrolysis, which method comprises the detecting step of detecting the changes in state of the electrolyzer by means of detectors fitted to the electrolyzer, and the adjusting step of adjusting, after the detecting step, the liquid electrolytic bath levels to a state allowing electrolysis.

After the start of heating the electrolyzer for melting the solid-form electrolytic bath, the changes in state of the electrolyzer are detected using the detectors fitted to the electrolyzer and, in this way, indirect judgment is made as to whether the melting of the electrolytic bath in the electrolyzer is already at a predetermined level or not. Based on this judgment, the liquid electrolytic bath surface levels are adjusted, after complete melting of the bath, to a state allowing electrolysis; in this way, the molten salt electrolytic bath can be automatically and safely shifted from the solid state to a state allowing the start of the operation.

The molten salt electrolyzer controlling method of the invention is preferably one further comprising, between the detecting step and the adjusting step, the confirmation step for confirming the completion of melting of the electrolytic bath.

Even if, in finally judging that the extent of melting is such that electrolysis can be carried out safely, the judgment of the state of melting of the electrolytic bath is still poor, it becomes possible to adjust, after completion of the melting of the bath, the liquid electrolytic bath surface levels to a state allowing electrolysis and thus cause automatic and safe shifting from the state in which the molten salt electrolytic bath is in a solid form to a state allowing the start of the operation by laying down an additional judgment criterion, verifying this based on experimental facts, rejudging of the completion of melting of the electrolytic bath based on the additional judgment criterion thus established.

The molten salt electrolyzer controlling method of the invention is preferably one in which the liquid electrolytic bath levels are adjusted to a state allowing electrolysis by gas introduction into or gas discharging from the anode chamber and/or the cathode chamber based on the state of the anode chamber and/or cathode chamber of the electrolyzer.

In cases where, after melting of the electrolytic bath in the electrolyzer, there is found an electrolytic bath level unbalance, it is necessary to dissolve the unbalance. On that occasion, the liquid electrolytic bath surface levels are balanced by gas introduction into or gas discharging from the anode chamber and/or cathode chamber based on the state of the anode chamber and/or cathode chamber resulting from division of the electrolyzer inside by insertion of a partition wall. If gas introduction into one chamber of the electrolyzer is undesirable, it is also possible to balance the liquid electrolytic bath levels by gas introduction into or gas discharging from the other chamber, with the chamber gas introduction into which is undesirable being taken as the reference.

By adjusting the liquid electrolytic bath surface levels to a state allowing electrolysis, it becomes possible to cause automatic and safe shifting from the state in which the molten salt electrolytic bath is in a solid form to a state allowing the start of the operation.

The gas to be introduced on that occasion is preferably a highly pure inert gas. When the purity of the gas generated matters little, the gas to be introduced is not limited to such inert gas. When a diluted gas is used, it is also possible to adjust the liquid electrolytic bath surface levels in advance using the same gas as the diluent gas.

The molten salt electrolyzer controlling method of the invention is preferably one in which the liquid electrolytic bath surface levels are adjusted to a state allowing electrolysis using a pressure sensor(s) and/or level sensor(s) fitted to the anode chamber and/or cathode chamber of the electrolyzer.

The simplest and most precise method of knowing the states of the liquid electrolytic bath surface levels in controlling the liquid electrolytic bath surface levels is the one measuring the pressures in the electrolyzer or the one using electrolytic bath level sensors.

By judging of the liquid electrolytic bath surface levels using such devices singly or in combination, it becomes possible to accurately adjust the liquid electrolytic bath surface levels and cause automatic and safe conversion of the molten salt electrolytic bath from the solid state to a state allowing the start of the operation.

Preferably, the molten salt electrolyzer controlling method of the invention further comprises, following the adjusting step, the dehydration step of continuing electrolysis while introducing an inert gas at least into the anode chamber for diluting the gas generated in the anode chamber with the inert gas.

Following the adjusting step of adjusting the liquid electrolytic bath surface levels to a state allowing electrolysis, an inert gas is introduced at least into the anode chamber to thereby replace the atmosphere in the anode chamber with the inert gas. Thereafter, electrolysis is started, and the gas generated in the anode chamber is forced out of the anode chamber by means of the inert gas, the electrolysis is then continued for a certain predetermined period of time while continuing inert gas introduction and, after reduction of the moisture content in the gas generated in the anode chamber and that in the electrolytic bath to sufficiently low levels, the inert gas introduction is discontinued and the operation proper is started. As a result, the formation of $OF_2$ resulting from reaction between oxygen gas and fluorine gas and becoming one of the factors causing explosion can be prevented and the electrolytic operation can be started safely.

In a preferred mode of carrying out the molten salt electrolyzer controlling method of the invention, the above inert gas introduction is effected by feeding an inert gas in an amount of 0.01 to 20% by volume of the capacity of the anode chamber of the electrolyzer.

When the feed amount is smaller, it becomes difficult to sufficiently inhibit the explosive reaction mentioned above. When the feed amount is excessive, the amount of the gas flowing in vain increases.

DETAILED DESCRIPTION OF THE PREFERRED EMBODIMENTS

Figure 1:
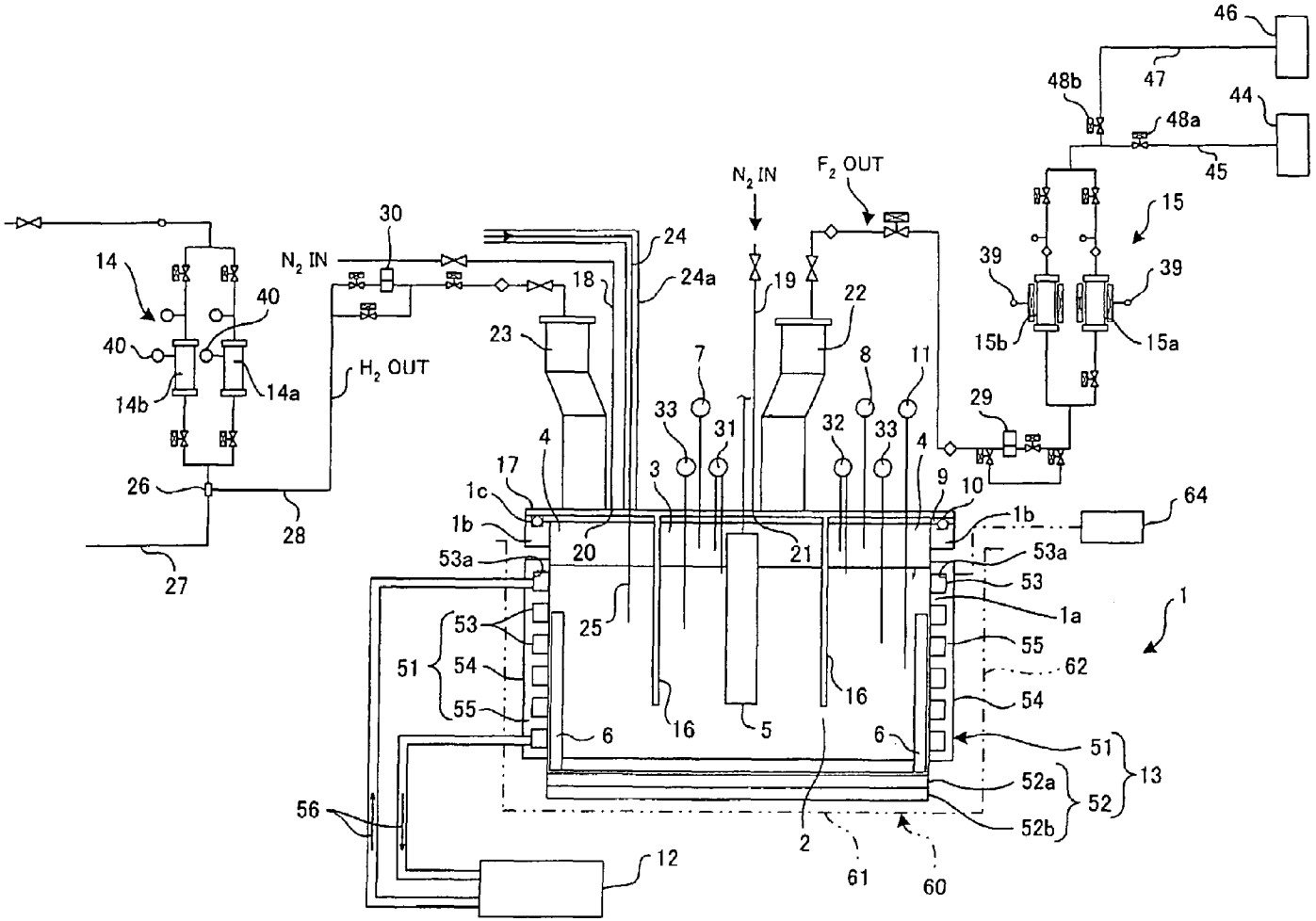
FIG. 1 is a schematic illustration of the principal parts of a fluorine gas generator as an embodiment of the present invention.

Now, referring to the drawings and taking the electrolyzer of a fluorine gas generator as an example of the embodiment of the molten salt electrolytic bath, the constitution of the molten salt electrolytic bath which is to be controlled according to the invention is described.

FIG. 1 is a schematic representation of the principal parts of the fluorine gas generator (molten salt electrolyzing apparatus) according to the invention. In FIG. 1, 1 is an electrolyzer constituted of an electrolyzer body 1*a* and an upper lid or covering 17, 2 is an electrolytic bath consisting of a fused or molten KF-HF system-based mixed salt, 3 is an anode chamber, 4 is a cathode chamber, 5 is an anode, and 6 is a cathode. 22 is an outlet port for fluorine gas generated from the anode chamber 3, and 23 is an outlet port for hydrogen gas generated from the cathode chamber 4. 11 is a temperature detector for measuring the temperature in the electrolytic bath 2, 13 is heat exchange means for the electrolyzer 1, and 12 is a temperature adjuster for feeding warm water to the heat exchange means 13. 51 is a warm water jacket disposed around the side faces of the electrolyzer 1 and serving as a constituent of the heat exchange means 13, and 52 is a heating member fitted to the bottom of the electrolyzer 1 and serving as a constituent of the heat exchange means 13. 18 and 19 are gas lines belonging to pressure maintenance means for maintaining the pressures in the anode chamber 3 and cathode chamber 4 at a predetermined level (e.g. atmospheric pressure). 15 is an HF eliminating column system for removing HF from the fluorine gas discharged from the anode chamber 3, and 14 is an HF eliminating column system for removing HF from the hydrogen gas discharged from the cathode chamber 4.

The electrolyzer 1 is made of such a metal as nickel, Monel, pure iron or stainless steel. The inside of the electrolyzer 1 is divided into the anode chamber 3 and cathode chamber 4 by means of a partition wall 16 made of Monel. Within the anode chamber 3, there is disposed the anode 5. In the cathode chamber 4, there is disposed the cathode 6. Preferably used as the anode 5 is a low-polarizable carbon electrode. Preferably used as the cathode 6 is Ni or iron, among others.

As shown in FIG. 1, on the upper covering 17 of the electrolyzer 1, there are provided the outlet port 22 for the fluorine gas generated from the anode chamber 3, the outlet port 23 for the hydrogen gas generated from the cathode chamber 4, an HF inlet 25 for feeding HF from an HF feeding line 24, purge gas outlets 20, 21 from the gas lines 18, 19, which are constituent elements of the pressure maintenance means for maintaining the anode chamber 3 inside and cathode chamber 4 inside at atmospheric pressure, pressure sensors 7, 8 for detecting the inside pressures in the anode chamber 3 and cathode chamber 4, respectively, level sensors 31, 32 for detecting the bath surface levels in the anode chamber 3 and cathode chamber 4, respectively, and detectors 33, 33 each constituted of a conduction detecting sensor and an alternating current type conduction detector and disposed in the electrolytic bath. The detectors 33, 33 may be replaced with the level sensors 32, 31 if the latter are equivalent in function to the former.

The outlet ports 22, 23 fitted to the upper covering 17 each comprises a bent pipe made of a material resistant to corrosion by fluorine gas, such as nickel or stainless steel, for preventing splashes from the anode chamber 3 and cathode chamber 4 from entering the gas lines.

The heat exchange means 13 is constituted of the warm water jacket 51 disposed so as to surround the outside periphery of the electrolyzer 1, and the heating member 52 fitted to the bottom of the electrolyzer 1. The heating member 52 may be of the ribbon type or nichrome wire type, for instance; the shape thereof is not particularly restricted. An insulator (not shown) is disposed around the warm water jacket 51.

The temperature adjuster 12 for feeding warm water obtained by heating pure water to the above-mentioned warm water jacket 51 is provided with heat medium heating means (not shown) for heating warm water 56 and temperature control means (not shown) for controlling the heat medium heating means. The temperature adjuster 12 is connected to the temperature detector 11, such as a thermocouple, for measuring the temperature of the electrolytic bath 2 in the electrolyzer 1, and feeds the warm water 56 to the warm water jacket 51 based on the temperature information from the temperature detector 11 so that the temperature of the electrolyzer 1 may be maintained at a constant level.

The pressure maintenance means for maintaining the pressures within the anode chamber 3 and cathode chamber 4 at atmospheric pressure maintains the pressures within the anode chamber 3 and cathode chamber 4 at atmospheric pressure by inert gas feeding into or gas discharging from the anode chamber 3 and/or cathode chamber 4. The fluorine gas and hydrogen gas generated upon electrolysis are pushed out of the electrolyzer 1 and discharged through the respective outlet ports 22, 23. In this way, the pressure maintenance means maintains the pressures within the anode chamber 3 and cathode chamber 4 at atmospheric pressure and thereby discharge the generated gases from the electrolyzer 1 and, at the same time, prevents the air from entering the electrolyzer 1.

The HF eliminating column system 15 for removing HF from the fluorine gas discharged from the anode chamber 3 comprises a first eliminating column 15*a* and a second eliminating column 15*b* disposed in parallel. The inside space of each column is packed with NaF, which removes HF contained in the fluorine gas discharged. This HF eliminating column system 15 is preferably made of a material resistant to corrosion by fluorine gas and HF, for example stainless steel, Monel or Ni.

On the upstream or downstream side of this HF eliminating column system 15, there is disposed a valve, for example an automatic valve 29, which is a constituent of the pressure maintenance means. The gas generated in the anode chamber 3 is in a severe environment in which HF gas and splashed of the electrolytic bath are generated together with fluorine gas. When the automatic valve 29 is present on the upstream side of the HF eliminating column system 15, it becomes easy to control the electrolyzer inside pressure. The environment in which fluorine gas and HF are intermingled becomes a strongly acidic atmosphere. Therefore, when the automatic valve 29 is disposed on the downstream side of the HF eliminating column system 15, a state such that HF-deprived fluorine gas alone occurs can be realized on that side, hence the opening and closing operations can be carried out without being influenced by HF gas. The position where the automatic valve 29 is to be disposed can be appropriately selected according to requirements.

Downstream from the HF eliminating column system 15, there is formed a gas line 47 branched from a gas line 45 connected to a compressor unit 44 and connected to a fluorine treatment unit 46. The changeover between the gas line 45 and gas line 47 can be freely accomplished by opening/closing automatic valves 48*a*, 48*b*. The fluorine gas treatment unit 46 treats the fluorine gas generated in the electrolyzer 1 and discharges the inert gas, among others, into the outside air.

Like the HF eliminating column system 15 mentioned above, the HF elimination column system 14 for removing HF gas in the hydrogen gas discharged from the cathode chamber 4 comprises a first eliminating column 14*a* and a second eliminating column 14*b* disposed in parallel. The first eliminating column 14*a* and the second eliminating column 14*b* may be used simultaneously or either one of them may be used singly. Like the HF eliminating column system 15, this eliminating column system 14 is preferably formed of a material resistant to corrosion by fluorine gas and HF, for example stainless steel, Monel or nickel. The inside of each column is packed with soda lime or sodium fluoride (NaF), by which HF in the hydrogen gas is eliminated. The HF eliminating column system 14 and HF eliminating column system 15 are provided with pressure gages 40, 39 and it is thus possible to detect possible clogging in the inside.

The HF eliminating column system 14 is disposed on the downstream side of an automatic valve 30, which is one of the constituents of the pressure maintenance means, and a vacuum generator 26 is disposed between this automatic valve 30 and the HF eliminating column system 14. This vacuum generator 26 can reduce the pressure in a gas line 28 by the ejector effect of the gas passing through a gas line 27.

The fluorine gas generator comprising such electrolyzer 1 is preferably disposed in a cabinet composed of one box-like body (not shown). This is because the on-demand, on-site operation is facilitated thereby. This cabinet is preferably made of a material hardly reacting with fluorine gas; for example such a metal as stainless steel or such a resin as polyvinyl chloride can be used.

Now, an explanation is made of the control method for starting the fluorine gas generator, which is an example of the embodiment of the present invention, from the solidified state of the electrolytic bath after stopping of the operation of that generator.

During operation in a steady state, the electrolytic bath surface levels are monitored by the level sensors 31, 32, among others, and the bath surface levels in the electrolyzer 1 are maintained in a balanced state through opening/closing of the gas lines 18, 19 for introducing an inert gas such as nitrogen gas or argon gas and/or by controlling the gas discharging. When the operation is suspended for maintenance or in case of emergency, for instance, the operation of the heat exchange means 13 is also discontinued, hence the molten mixed salt 2 in the electrolyzer 1 takes a solidified form. Upon discontinuation of electrolysis, the residual fluorine gas in the anode chamber 3 is adsorbed on the carbon electrode 5, and the pressure in the anode chamber 3 lowers and the bath liquid surface in the anode chamber 3 rises. And, the bath gradually solidifies with the liquid surface in the anode chamber 3 remaining at an elevated level. When the electrolysis is restarted by remelting the electrolytic bath while the bath surface level is in an unbalanced condition, the liquid surface on the cathode chamber side in the electrolyzer 1 will remain at a lowered level and, if there is clogging of the opening of the piping or some or other pressure fluctuation occurs, the $H_2$ generated in the cathode chamber 4 may pass under the partition wall and, as a result, the fluorine gas and hydrogen gas may be mixed together in the liquid phase, resulting in starting material recovery or, in the worst case, they may be mixed together in the gaseous phase, possibly resulting in explosion.

Figure 2:
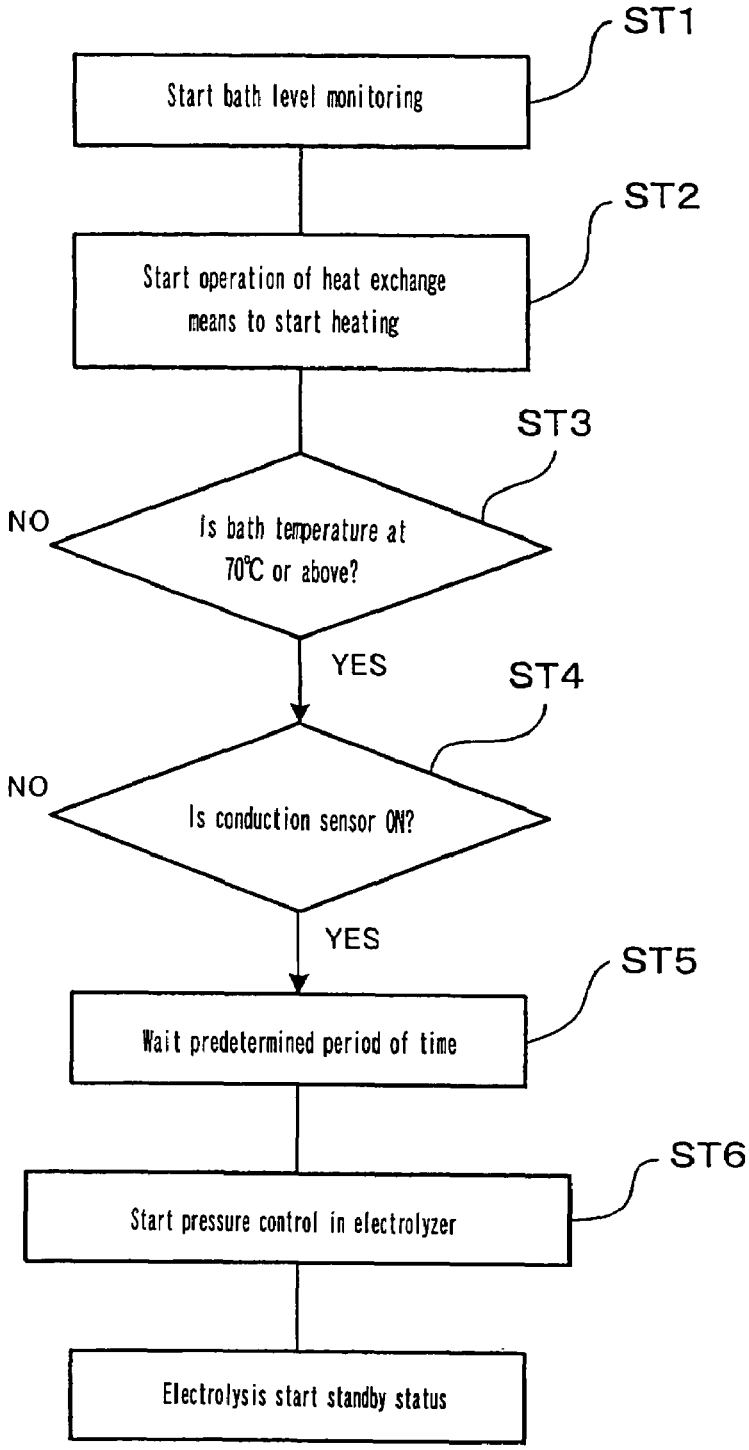
FIG. 2 is a flowchart illustrating an example of the molten salt electrolytic bath controlling method of the invention.

Therefore, referring to the flowchart shown in FIG. 2, the method of controlling the electrolyzer 1 by which the operation can be restarted after solidification of the bath is now described.

First, in step (hereinafter abbreviated as ST; hereinafter the same shall apply) 1, warming of the electrolytic bath is started. The operation of the above-mentioned heat exchange means 13 is started (ST2) so that the bath temperature may arrive at a level not lower than 70° C. in the case of the bath consisting of KF-2HF-based molten mixed salt in this embodiment example, although the bath temperature may vary according to the bath species. The bath temperature is measured by means of the temperature detector 11 (ST3) and, after arrival at the required temperature, the next step (ST4) begins.

When the bath begins to melt with the rise in bath temperature, the detector 33 constituted of a conduction type detecting sensor and an alternating current type conduction detector detects conduction. This is because when the bath is in a solid state, it is in an electrically insulated state. With the time of conduction detection by the detector 33 (ST4) being taken as a reference time, a timer is actuated so that the heating of the electrolyzer by the heat exchange means 13 may be continued for a predetermined period of time (ST5). After the lapse of the predetermined period, pressure controlling of the anode chamber 3 and cathode chamber 4 is then started through the pressure sensors 7, 8 (ST6).

For the pressure control, a timer is actuated for a predetermined period of time, and the fluctuations in pressure during that period are ignored. This is because immediately after complete melting of the bath, the bath surface levels are unstable and the fluctuations in pressure are great. After the lapse of that predetermined period, the pressure in the anode chamber 3 is measured by means of the pressure sensor 7. Then, the pressure in the cathode chamber 4 is measured by means of the pressure sensor 8 for comparison with the pressure in the anode chamber 3. If the pressure in the cathode chamber 4 is higher, a small amount of gas is discharged. If, conversely, the pressure in the cathode chamber 4 is lower than that in the anode chamber 3, nitrogen gas or the like is fed to the cathode chamber 4 through the gas line 18 to adjust the pressure therein to a level almost equal to the pressure in the anode chamber 3. In this way, by adjusting the pressure on the side of the cathode chamber 4, it is possible to prevent the anode chamber 3 from being contaminated with an impurity or impurities and maintain the purity of the fluorine gas generated in the anode chamber 3 at a high level.

In this manner, the pressures in the anode chamber 3 and cathode chamber 4 are controlled and the bath surface levels are controlled within a range allowing electrolysis to make it possible to start electrolysis.

In pressure monitoring, the bath surface levels are detected by means of the level sensors 31, 32 disposed in the anode chamber 3 and cathode chamber 4, respectively, and pressure measurements are made at the same time, whereby it becomes possible to detect the liquid surface levels in the anode chamber 3 and cathode chamber 4 with more certainty, hence safer automatic operation becomes possible.

In the above-mentioned control method, the bath temperature is measured and conduction detections by the detectors are carried out simultaneously, and the time of conduction detection by the conduction detector is taken as a reference point. Alternatively, it is also possible to dispose conduction detectors alone and take the time of conduction detection by the conduction detectors as a reference point, or dispose a temperature detector alone and take, as a reference point, the time after the lapse of a certain predetermined period following arrival of the results of measurements by the temperature detector at a constant level.

Now, an explanation is given of the dehydration step to be carried out according to need after arrival of the fluorine gas generator, which is an embodiment of the present invention and is constituted in the above manner, at a state allowing electrolysis by the control method mentioned above but prior to starting the electrolytic operation proper.

In producing fluorine by electrolysis, the KF-2HF electrolytic bath is generally used and, in this electrolytic process, explosion occurs frequently during electrolysis. This phenomenon has not been fully elucidated as yet. However, the following situation is presumably one of the causes thereof. Generally, the KF-2HF electrolytic bath is highly hygroscopic, hence it is possible that the bath contain moisture as a result of moisture entering the electrolyzer 1 during the period of suspension of the apparatus. When electrolysis is carried out in the presence of water in the bath, water is also electrolyzed and oxygen gas is generated from the anode 5 since water is lower in electrolytic potential than HF. The $F_2$ and $O_2$ generated upon electrolysis react with each other in the anode chamber 3 to give oxygen difluoride ($OF_2$). Since $OF_2$ is an unstable material, it readily causes explosion, possibly damaging the anode 5 and the electrolyzer 1, among others. It is the dehydration step that becomes necessary to adjust the electrolytic bath while preventing such explosion during fluorine generation by electrolysis. When the suspension period is prolonged, the possibility of moisture entering the electrolyzer 1 increases accordingly. Since it is difficult to measure the moisture content in the electrolytic bath in the fluorine-generating electrolyzer during operation, the length of the suspension period serves as a measure for estimating the moisture content in the electrolytic bath.

Figure 3:
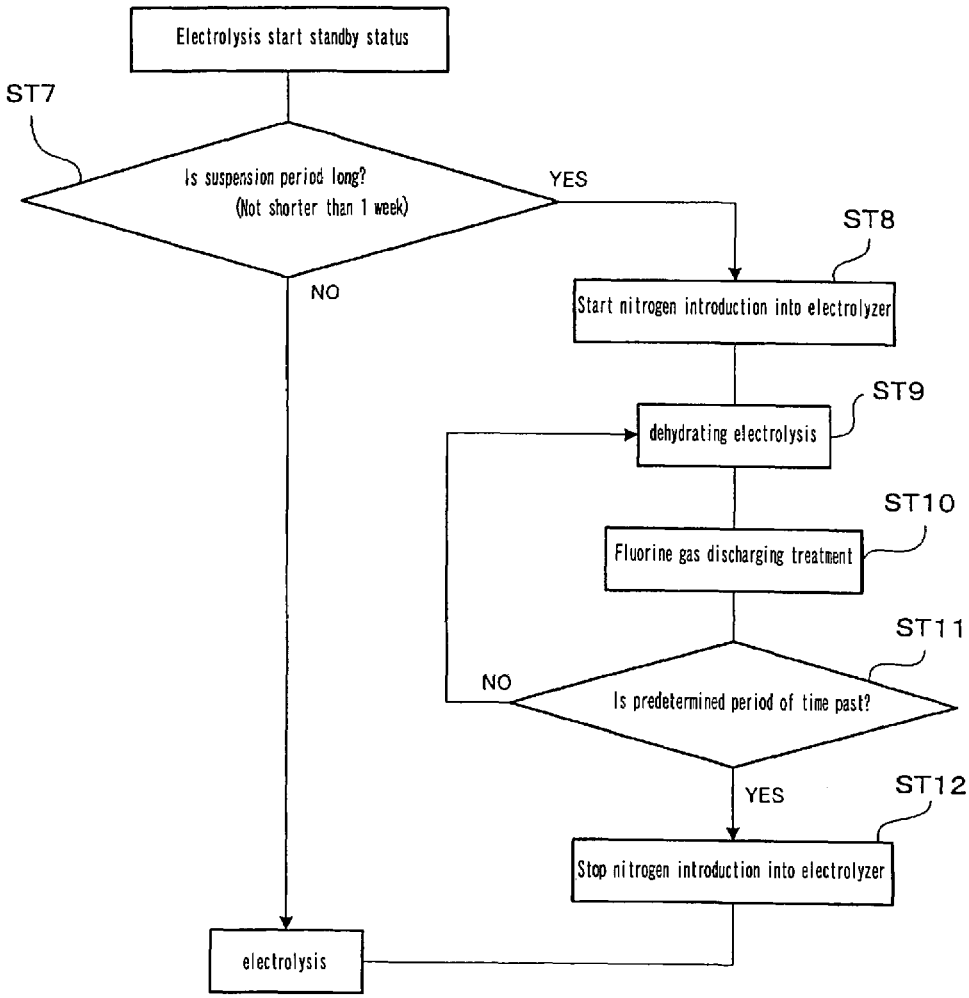
FIG. 3 is a flowchart illustrating an example of the step of dehydrating the molten salt electrolytic bath according to the invention.

Therefore, referring to the flowchart shown in FIG. 3, an explanation is given of the dehydration step in the electrolyzer 1 to be added on the occasion of restarting electrolysis after suspension of electrolysis.

In an electrolysis start standby status, ST7 in FIG. 3 is carried out, and judgment is made as to whether the suspension period is long or not. By saying that the suspension period is long, it is meant that the suspension period is not shorter than 1 week, for instance. When the suspension period is not long, ST13 is carried out and the ordinary electrolytic operation is carried out. When, however, the suspension period is long, ST8 is carried out, namely the atmosphere in the electrolyzer 1 is replaced with nitrogen gas. Another high-purity inert gas such as argon gas may be used in lieu of nitrogen gas.

Further, ST9 is carried out, and the electrolytic operation for dehydration is started. Moisture is electrolyzed, and oxygen gas is generated from the anode and hydrogen gas from the cathode. The oxygen gas generated from the anode together with fluorine gas is diluted and diffused by nitrogen gas introduction and pushed out of the electrolyzer 1 together with the fluorine gas. The amount of nitrogen gas to be fed on that occasion is preferably 0.01 to 20% by volume relative to the capacity of the anode chamber of the electrolyzer. Thereafter, ST10 is carried out for fluorine gas discharging treatment. On that occasion, the gas feeding to the compressor unit 44 downstream from the fluorine gas outlet port 22 is stopped, and gas feeding is carried out to the fluorine treatment unit 46. The fluorine treatment unit 46 adsorbs the fluorine gas from among the fluorine gas, nitrogen gas, etc. discharged from the electrolyzer 1 and discharges the nitrogen gas etc. into the outside air.

Then, ST11 begins, and judgment is made as to whether the period of the dehydrating electrolysis amounts to a predetermined period of time. When the electrolyzer has a bath capacity of 3 liters, for instance, the dehydration electrolysis can be finished after 100 A·hr or higher power supply. The judgment as to whether the moisture content of the bath is already at a sufficiently low level or not is made by an operator based on his/her experience. The judgment may also be made using a measurement apparatus for measuring the moisture content of the bath. In case the time after starting the dehydrating electrolysis with nitrogen gas introduction is shorter than the predetermined period of time, the judging procedure in ST11 is continued. After the lapse of the predetermined period, ST12 is carried out and the nitrogen gas introduction is stopped. The moisture content of the bath on that occasion is preferably not more than 500 ppm, more preferably not more than 200 ppm. The gas feeding to the fluorine treatment unit 46 is stopped, and gas feeding is made to the compressor unit 44, and the ordinary electrolytic operation is carried out. The fluorine gas generated at the anode 5 is fed to the compressor unit 44.

In this manner, the moisture content in the electrolyzer is reduced to a sufficiently low level by starting electrolysis while diluting the atmosphere in the electrolyzer 1 with nitrogen gas and by discharging the oxygen gas etc. generated at the anode out of the electrolyzer. Then, the nitrogen gas introduction is stopped, and the ordinary electrolytic operation is started.

The judgment as to whether the nitrogen gas introduction is to be carried out nor not (ST7) may also be made based on the moisture content of the electrolytic bath consisting of a mixed molten salt. When, even after a long period of suspension of electrolysis, the water content is not more than 500 ppm, preferably not more than 200 ppm, nitrogen gas introduction is unnecessary, since the possibility of explosion resulting from reaction between oxygen gas and fluorine gas is very low.

Conversely, when the moisture content is higher than 500 ppm even if the period of suspension of electrolysis is short, nitrogen gas introduction is necessary for preventing explosion.

When the fluorine gas generator having the above constitution is operated by the above-mentioned method of controlling, the liquid surface levels of the electrolytic bath can be balanced to thereby realize a state in which electrolysis can be carried out safely and, furthermore, the moisture content of the electrolytic bath can be reduced to make it possible to carry out the electrolysis safely.

What is claimed is:

1. An apparatus for controlling a molten salt electrolyzer, comprising:

a tank configured to hold an electrolytic bath in a solid form;

a heater configured to melt the electrolytic bath;

a pressure sensor configured to detect the electrolytic bath change from a solid to a liquid and to determine when the electrolytic bath is molten; and an adjusting unit configured to adjust, after the sensor detects the change from a solid to a liquid, a surface level of the liquid electrolytic bath.

2. The molten salt electrolyzer controlling apparatus according to claim 1, further comprising:

a sensor configured to detect changes in electric resistance of the electrolytic bath; and a temperature sensor configured to detect changes in a temperature of the electrolytic bath.

3. The molten salt electrolyzer controlling apparatus according to claim 1, further comprising:

a conduction detecting sensor and an alternating current conduction detector, each inserted in the electrolytic bath.

4. A method of controlling a molten salt electrolyzer, comprising:

automatically converting, by melting, a solid electrolytic bath contained in the electrolyzer to a liquid;

determining when the electrolytic bath is molten by detecting the electrolytic bath change from a solid to a liquid with a pressure sensor fitted to the electrolyzer; and adjusting, after the determining step, a surface level of the liquid electrolytic bath surface.

5. The molten salt electrolyzer controlling method according to claim 4, wherein the adjusting further comprises:

adjusting the surface level of the liquid electrolytic bath by introducing gas into or discharging gas from an anode chamber of the electrolyzer or a cathode chamber of the electrolyzer.

6. The molten salt electrolyzer controlling method according to claim 4, wherein the adjusting further comprises:

adjusting the surface level of the liquid electrolytic bath by using the pressure sensor or a level sensor fitted to the anode chamber or cathode chamber of the electrolyzer.

7. The molten salt electrolyzer controlling method according to claim 4, further comprising:

following the adjusting step, continuing electrolysis while introducing an inert gas at least into an anode chamber of the electrolyzer by feeding the inert gas to the anode chamber.

8. The molten salt electrolyzer controlling method according to claim 7, wherein the inert gas introduction is effected by feeding the inert gas in an amount of 0.01 to 20% by volume of a capacity of the anode chamber of the electrolyzer.

* * * * *